US008413305B2

(12) United States Patent
Henninger

(10) Patent No.: US 8,413,305 B2
(45) Date of Patent: Apr. 9, 2013

(54) CIRCULAR COMB

(75) Inventor: Friedrich Henninger, Flachslanden (DE)

(73) Assignee: Staedtler + UHL KG, Schwabach (DE)

( * ) Notice: Subject to any disclaimer, the term of this patent is extended or adjusted under 35 U.S.C. 154(b) by 0 days.

(21) Appl. No.: 13/265,558

(22) PCT Filed: Apr. 14, 2010

(86) PCT No.: PCT/EP2010/002285

§ 371 (c)(1), (2), (4) Date: Oct. 21, 2011

(87) PCT Pub. No.: WO2010/121736

PCT Pub. Date: Oct. 28, 2010

(65) Prior Publication Data

US 2012/0030907 A1 Feb. 9, 2012

(30) Foreign Application Priority Data

Apr. 21, 2009 (DE) ..... 10 2009 018 058

(51) Int. Cl.
*D01G 19/10* (2006.01)

(52) U.S. Cl.
USPC ..... 19/128

(58) Field of Classification Search ..... 19/113, 19/114, 128, 233
See application file for complete search history.

(56) References Cited

U.S. PATENT DOCUMENTS

| | | | | |
|---|---|---|---|---|
| 4,394,789 A | | 7/1983 | Egerer | |
| 4,498,217 A | * | 2/1985 | Engels | 26/9 |
| 4,513,480 A | | 4/1985 | Bisquolm et al. | |
| 4,516,292 A | * | 5/1985 | Quay | 19/112 |
| 4,531,265 A | * | 7/1985 | Engels | 26/9 |
| 4,606,095 A | * | 8/1986 | Egerer | 19/97 |
| 4,627,131 A | * | 12/1986 | Iwata | 19/97 |
| 4,716,629 A | | 1/1988 | Iwata et al. | |
| 4,893,380 A | | 1/1990 | Graf | |
| 5,038,440 A | * | 8/1991 | Demuth et al. | 19/114 |
| 5,054,166 A | * | 10/1991 | Demuth et al. | 19/113 |
| 5,109,574 A | * | 5/1992 | Eichenberger | 19/234 |
| 5,467,505 A | | 11/1995 | Graf | |
| 6,748,628 B2 | * | 6/2004 | Sauter et al. | 19/113 |
| 7,587,792 B2 | * | 9/2009 | Schmitz | 19/113 |

(Continued)

FOREIGN PATENT DOCUMENTS

| | | |
|---|---|---|
| DE | 2503976 A1 | 8/1975 |
| DE | 3005399 A1 | 8/1980 |

(Continued)

*Primary Examiner* — Shaun R Hurley

(74) *Attorney, Agent, or Firm* — Browdy and Neimark, PLLC

(57) ABSTRACT

Circular comb for a combing machine for combing textile fibers, comprising a base body with a center longitudinal axis, a peripheral surface and two end faces, a plurality of bar tacks, which are arranged on the peripheral surface of the base body and define a combing region of the circular comb, a plurality of fastening devices attached to the base body for the non-positive connection of one of the bar tacks in each case to the base body and unlocking units to release the non-positive connections, each unlocking unit having an unlocking device and an unlocking means to actuate the unlocking device, wherein the unlocking units are accessible from outside the combing region, in particular from at least one of the end faces, and an additional positive securing connection to secure the bar tacks is provided on the base body.

25 Claims, 9 Drawing Sheets

U.S. PATENT DOCUMENTS

| | | | | |
|---|---|---|---|---|
| 2001/0018781 | A1* | 9/2001 | Wurst | 19/113 |
| 2007/0006424 | A1 | 1/2007 | Landmesser | |
| 2009/0151127 | A1* | 6/2009 | Leder et al. | 19/114 |
| 2010/0236025 | A1* | 9/2010 | Leder et al. | 19/113 |

FOREIGN PATENT DOCUMENTS

| | | | |
|---|---|---|---|
| DE | 3007245 | A1 | 9/1981 |
| DE | 4326203 | C1 | 2/1995 |
| DE | 102006005605 | A1 | 1/2007 |
| EP | 0091986 | A1 | 10/1983 |
| EP | 0179158 | A1 | 4/1986 |
| EP | 0249706 | A2 | 12/1987 |
| EP | 0253071 | A2 | 1/1988 |
| EP | 0322472 | A1 | 7/1989 |
| EP | 0839934 | A1 | 5/1998 |
| EP | 1523591 | A1 | 4/2005 |
| EP | 1533404 | A1 | 5/2005 |
| GB | 274698 | A | 7/1927 |
| GB | 1462608 | A | 1/1977 |
| GB | 2046805 | A | 11/1980 |
| WO | WO 2004009885 | A1 | 1/2004 |

* cited by examiner

CIRCULAR COMB

RELATED APPLICATIONS

This application claims the priority of German Patent Application, Serial No. 10 2009 018 058.3, filed Apr. 21, 2009, pursuant to 35 U.S.C. 119(a)-(d), the content of which is incorporated herein by reference in its entirety as if fully set forth herein.

FIELD OF THE INVENTION

The invention relates to a circular comb for a combing machine for combing textile fibres.

BACKGROUND OF THE INVENTION

Combs for use in combing machines are known in the form of round combs from public prior use, at least one comb element, which is engaged with the fibres to be combed, being arranged on a base body. A comb, which has a plurality of comb elements along its entire periphery, is called a circular comb. The active combing region may be, in this case, 78°, 90°, 111°, 180° of the periphery of the surface line of the comb. Circular combs are also known, in which the entire surface line is taken up with comb elements, such as needles, needle strips, saw-tooth wire portions, comb teeth or saw-tooth stamped parts. These comb elements, which are per se preassembled, are also called bar tacks.

SUMMARY OF THE INVENTION

A bar tack thus has a plurality of saw-tooth stamped parts arranged one behind the other in the direction of a centre longitudinal axis of the base body or also toothed discs with teeth. The teeth wear because of their mechanical engagement in the fibres to be combed, so it is necessary for the bar tacks to be replaceable in design. For this purpose, various fastening devices are known:

Card clothings for flat lids of a carding machine are disclosed in DE 43 26 203 C1, EP 0 091 986 A1 and EP 0 322 472 A1, the card clothing consisting, similarly to a bar tack of a circular comb, of a plurality of saw-tooth wire strips arranged in parallel to one another. The individual saw-tooth wire strips are placed in a row on a base body and held by a positive connection by means of adjacent fastening strips. The lateral fastening of the saw-tooth wire strips on the base body can also take place by means of clamping, in other words by a non-positive connection. As EP 0 322 472 A1 shows, the individual saw-tooth wire strips can be repeatedly bent in the arrangement direction. The fastening of the card clothing on the cover of the carding machine also takes place by means of the fastening strips, which are pushed onto the cover.

A similar fastening system of toothed discs on a bar tack of a circular comb is known from DE 25 03 976 C3, the individual toothed discs of a bar tack being clamped by means of a spring clamp onto a bar section. The entire bar tack is screwed to the base body of the circular comb. This type of fastening of the bar tack on the base body is also known in principle from GB 274 698 and DE 30 05 399 A1, a better seat of the bar tacks on the base body being achieved, according to the latter, in that they additional have a clamping strip and are arranged therewith in a recess of the base body corresponding thereto.

Further configurations of clamping strips are known from DE 30 07 245 A1, EP 0 249 706 A2, EP 0 179 158 B1 and EP 0 839 934 A1, a screwing connection of the clamping strips in the operating state, in other words when the bar tack is pushed on, being accessible from the inner wall of the hollow cylindrical base body. This accessibility of the screw connections from the inner wall of the base body is limited. On the other hand, a clamping strip is positively held according to EP 1 523 591 B1 both in the base body and in the bar tack. The assembly and disassembly of this comb are very laborious.

Furthermore, various possibilities for positively connecting bar tacks in the form of tooth clothings on the base body of a round comb are described in EP 1 533 404 A1.

According to U.S. Pat. No. 4,716,629, the fastening of a bar tack in a base body takes place by means of a resilient clamping element, which may, for example, be configured as a slotted sleeve. The clamping element is inserted into a groove, which is formed by the base body and the bar tack and extends parallel to the centre longitudinal axis of the base body. The holding force of a clamp with a clamping element of this type is low. Moreover, an additional securing of the clamping element against unintentional release is necessary.

It therefore applies to all the fastening systems mentioned that an assembly and disassembly of the bar tack to or from the base body of the circular comb is only possible by laborious assembly and retrofitting operations. This takes place, for example, by means of numerous screwing operations of the clamping and fastening strips and/or by axially pushing them on in the direction of the centre longitudinal axis of the base body, causing long setting up times and therefore stoppage times of the combing machine.

Spring-like holding parts, which are rigidly connected to the base body of a circular comb and on which the bar tack is placed and held as a result of the resilient spring force, are known from EP 0 253 071 A2. The simplified assembly process is counteracted by a reduced mechanical holding force between the bar tack and the base body.

DE 10 2006 005 605 A1 discloses a device on a carder, wherein a clothing is held by a magnet. The translational speed of the carder is significantly reduced in comparison to the rotational speeds of the circular comb conventional in combing machines, so that the centrifugal forces acting on a bar tack of the circular comb, which quadratically depend on the rotational speed, are significantly greater than the negligible centrifugal forces acting on the carder. The magnetic holding force for the clothing of the carder is configured thereon to withstand the effects of force on the clothing caused by the process, these effects of force caused by the process being smaller than those which act on a bar tack of a circular comb when combing fibres.

It is therefore an object of the invention to design a circular comb for a combing machine in such a way that a bar tack can be directly and quickly connected to a base body, it being impossible to release the connection even with high loads.

This object is achieved according to the invention by a circular comb, in which the unlocking units are accessible from outside the combing region, in particular from at least one of the end faces, and an additional positive securing connection to secure the bar tacks is provided on the base body.

It was recognized according to the invention that a circular comb with a base body and a plurality of bar tacks connected thereto in a non-positive manner has unlocking units, which in each case comprise an unlocking device and an unlocking means, and a securing of the connection of the bar tacks to the base body against unintentional release is ensured by an additional positive connection. The bar tack can be released from the base body by actuating the unlocking device by means of the unlocking means, the unlocking process being facilitated, in particular because of the arrangement of the unlocking units outside a combing region, which is determined by the bar tacks, and, in particular on the end faces of the base body because of the good accessibility. Moreover, owing to the additional positive securing connection between the bar tack and the base body, a secured connection of the two components to one another is guaranteed in case, in the event of damage, the non-positive connection between the bar tack and the base body is not maintained. This is relevant, in particular, for circular combs, which are used at high rotational speeds of up to 500 $min^{-1}$ and with a high comb load, so that a bar tack, which could possibly be released from the base body as a result of the very high force loads during combing operation, does not cause damage to the combing machine. A further advantage of the circular comb according to the invention is the uncomplicated configuration of the geometry of the base body, resulting in a reduction in its production costs, and therefore the production costs of the circular comb as a whole are reduced.

In a circular comb, in which the positive securing connection between one of the bar tacks and the base body in each case has a radial play, the positive securing connection between one of the bar tacks and the base body has radial play, so the positive connection only engages if the non-positive connection between the bar tack and base body is removed. The non-positive connection, which is present in the usual operation of the combing machine, is free of play.

Owing to the configuration of the radial play being smaller than a radial spacing of the bar tack non-positively connected to the base body from a machine wall of the combing machine, it is ensured that in the case of unintentional release of a bar tack from the base body during running operation of the combing machine, destruction of said combing machine by the released bar tack is avoided.

By using a bar tack and a fastening device designed such that assembly and disassembly of the bar tack on or from the base body substantially take place in the radial direction, it is possible to carry out the assembly and disassembly of the bar tack on or from the base body substantially in the radial direction in the combing machine. This dispenses with the withdrawal of the bar tack from the base body of the circular comb and therefore simplifies the necessary setting-up processes and therefore shortens the time outlay required for this. Moreover, a partial integration is possible in that a drive shaft of the combing machine and a base body, which is generally assembled on the drive shaft, are combined in the base body according to the invention. Production and assembly costs of the combing machine are therefore reduced. Moreover, the necessary space requirement in and on the combing machine is reduced when the unlocking means is assembled.

The use of an unlocking opening in the base body, which extends parallel to the centre longitudinal axis, as an unlocking device, and an unlocking pin, which can be moved to release the non-positive connection in the unlocking opening, as an unlocking means, makes possible a particularly rapid and easy unlocking of the bar tack from the base body by releasing the non-positive connection. Moreover, a very compact construction of an unlocking unit of this type is possible as the unlocking opening is integrated in the base body. Furthermore, the assembly and disassembly process between the bar tack and the base body is facilitated by using the radial play, the securing function of the positive connection being maintained at the same time.

With the design of a circular comb, in which the bar tack and the fastening device are designed such that a combing force acts as a closing force in a securing manner on the bar tack, a combing force active during combing operation acts as an additional securing mechanism on the non-positive connection of the fastening device to the base body, so the risk of unintentional unlocking of the fastening device and therefore a release of the bar tack is additionally reduced.

A fastening device comprising a profile strip and a leaf spring is distinguished by a compact and integrative mechanical structure.

A circular comb, in which each profile strip has a top piece with at least one laterally projecting nose to engage in undercut recesses of the bar tack, allows a secure and, at the same time, assemblable and disassemblable connection of the bar tack to the connection device.

Owing to the design of the fastening device and a bar tack, in which a T-shaped top piece with two laterally projecting noses, at least one nose, in the direction parallel to the centre longitudinal axis, having interruptions, which correspond with corresponding recesses of the bar tack for the assembly and disassembly thereof, assembly and disassembly of the bar tack on or from the base body take place easily and quickly. By displacing the bar tack parallel to a centre longitudinal axis of the base body by a certain amount of length, the bar tack can be inserted in or removed from the base body in the radial direction.

An assembly or disassembly process of a bar tack on the circular comb is additionally simplified with a fastening device comprising an L-shaped top piece with a laterally projecting nose.

With a circular comb, in which the leaf spring, to non-positively connect the bar tacks and base body, is held with a first spring part region in a receiving groove of the profile strip and rests with a second spring part region on a shoulder of a fastening groove of the base body, the non-positive connection of the bar tack and base body is produced by a prestressed leaf spring. The resulting holding force of the bar tack on the base body can be adjusted by adaptation of the leaf spring.

A fastening device, in which each profile strip has an T-shaped base with a contact face provided on a T-shaped side projection, wherein the contact face, to form the positive securing connection, can rest on the leaf spring and therefore indirectly also on the shoulder of the fastening groove and wherein the radial play is determined by the design of the contact face, the leaf spring and the fastening groove, allows the use of the radial play by unlocking the non-positive connection of the bar tack in the base body for disassembly.

A circular comb, in which the unlocking pin is rotatably arranged in the unlocking opening and the contour of the cross-sectional face of the unlocking pin running perpendicular to the centre longitudinal axis is not round, allows a simple unlocking process in that the unlocking pin is inserted in the unlocking opening and rotated about a longitudinal axis of the unlocking pin.

A fastening device, in which the fastening device is a rod-shaped magnet, the non-positive connection between the bar tack and the base body being provided by the magnetic force of the magnet, allows very good integration into the base body. Moreover, the effect of force on the holding force of the bar tack on the base body is integrated in the fastening device. The magnetic holding force of the fastening device can be influenced by the design thereof.

A fastening device, in which the magnet is a permanent magnet, ensures a secure and lasting holding force on the bar tack.

By using a fastening device, in which the magnet is an electromagnet, the magnetic effect of which can be activated and deactivated by means of a switch, the effect of force on the bar tack, in particular for an assembly or disassembly process, can be interrupted and then reproduced.

A particularly compact structure of the circular comb is produced by an arrangement of the fastening device, in which the magnet is rigidly arranged in a fastening groove of the base body.

In a circular comb, in which each bar tack has a hook-like step, which, to form the positive securing connection, engages in a receiving opening of the fastening groove limited by a projection, the radial play being determined by a radial spacing provided in a non-positive connection between the projection and the hook-like step engaging below the projection, the bar tack is secured by the positive securing connection against unintentional release from the non-positive connection of the bar tack on the base body. In this case, the bar tack and the base body are designed in such a way that with an existing non-positive connection, a radial play is present between the bar tack and the base body, which facilitates the assembly and disassembly of the bar tack on or from the base body.

With a circular comb, in which the magnet has a C-shaped cross-section perpendicular to the centre longitudinal axis, the unlocking opening being formed by the magnet and the bar tack connected thereto, the unlocking opening is integrated into the structure of the circular comb and does not have to be introduced into the base body of the circular comb in an additional manufacturing step.

The use of an unlocking pin in a circular comb which is conical at least in portions allows rapid and direct unlocking of the bar tack from the base body by insertion of the unlocking pin parallel to a centre longitudinal axis of the base body into the unlocking opening.

The exchange process of a worn bar tack is simplified with a configuration of the fastening devices and the unlocking units, in which the fastening devices and the unlocking units are attached to the base body in such a way that they are connected, both during combing operation and also during assembly and disassembly of the bar tack on or from the base body, to said base body and can be brought, at least partially, into a loosened, but not completely separated assembly or disassembly state.

It is a further object of the invention to design a circular comb for a combing machine in such a way that a bar tack can be connected directly, rapidly and without additional aids to a base body.

This object is achieved according to the invention by a circular comb, in which the unlocking units are accessible from outside the combing region, in particular from at least one of the end faces, and the fastening devices and the unlocking units are attached to the base body in such a way that both during combing operation and also during assembly and disassembly of the bar tack on or from the base body, they are connected to the latter and can, at least partially, be brought into a loosened, but not completely separated assembly or disassembly state.

The advantageous configurations described above can also be used in such a circular comb.

It was recognized according to the invention that a circular comb with a base body and a plurality of bar tacks non-positively connected thereto has fastening devices and unlocking units, which in each case comprise an unlocking device and an unlocking means. Both the fastening devices and the unlocking units are releasably attached, in particular, to the base body and, to assemble and disassemble the bar tack to or from the base body, remain mounted thereon. They are attached to the base body in such a way that both during combing operation and during the assembly and disassembly of the bar tack on or from the base body, they remain connected thereto and can be brought, at least partially, into a loosened, but not completely separated assembly or disassembly state. As a result, an exchange process of a worn bar tack is simplified.

An unintentional release of the bar tack from the base body is prevented by a circular comb, in which an additional positive securing connection is provided to secure the bar tacks on the base body.

Embodiments of the invention will be described in more detail below with the aid of the drawings.

DESCRIPTION OF THE PREFERRED EMBODIMENTS

Figure 1:
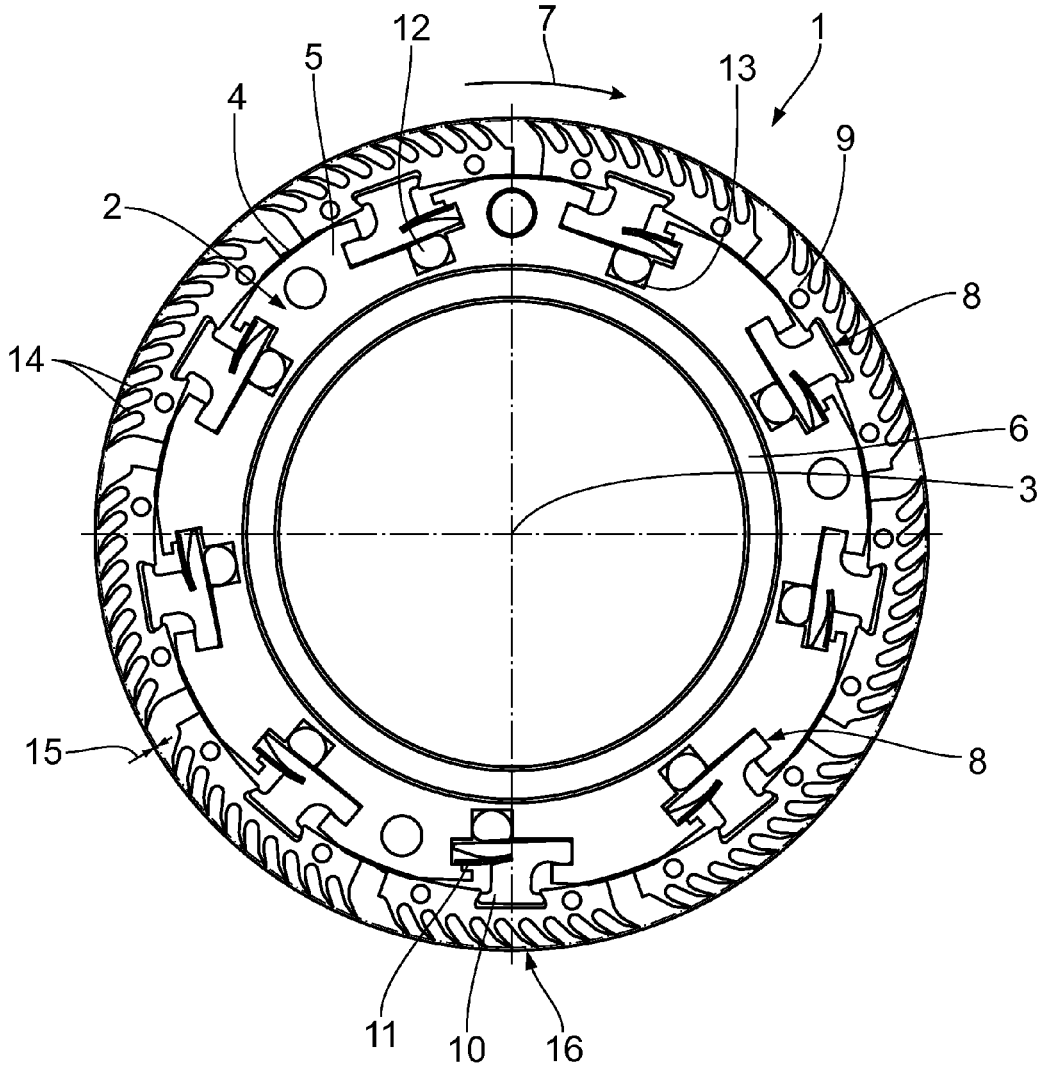
FIG. 1 shows a side view of a circular comb with nine bar tacks fastened thereon in the peripheral direction.

A circular comb 1 shown in FIG. 1 has a hollow cylindrical base body 2 with a centre longitudinal axis 3, an outer peripheral surface 4 and two end faces 5, of which only one is visible. The base body 2 is placed on a drive shaft 6, which is also hollow cylindrical. It is also possible for the base body 2 to be driven directly, in other words without an additional drive shaft 6. For this purpose, the base body 2 can be configured both as a hollow and as a solid shaft.

A total of nine bar tacks 9 fastened in each case by means of a fastening device 8 are attached to the base body 2 in the peripheral direction 7. The bar tacks 9 define, with their axial extent parallel to the centre longitudinal axis 3, a combing region of the circular comb.

Each fastening device 8 comprises a profile strip 10 and a leaf spring 11, by means of which the respective bar tack 9 is fastened non-positively to the base body 2. To unlock the non-positive connection, an unlocking means in the form of an unlocking pin 12 is used, which is arranged in an unlocking device, which extends as an unlocking opening 13 proceeding from at least one of the end faces 5 in the base body 2 parallel to the centre longitudinal axis 3. Thus, the unlocking opening 13 is accessible from outside the combing region. To unlock the non-positive connection between the bar tack 9 and the base body 2, the unlocking pin 12 can be introduced into the unlocking opening 13 and moved within the latter (here: rotated). During the combing operation of the circular comb 1, for weight and safety reasons, no unlocking pin 12 is generally provided in the unlocking opening 13.

Each bar tack 9 comprises a plurality of identically punched toothed discs, which are placed in a row one behind the other in the direction of the centre longitudinal axis 3 and connected to one another. Each toothed disc has a plurality of teeth 14, which engage in the fibres to be combed. The bar tacks 9 are fastened to the base body 2 in such a way that each bar tack 9 has a radial spacing 15 from a machine wall 16 of a combing machine.

Figure 2:
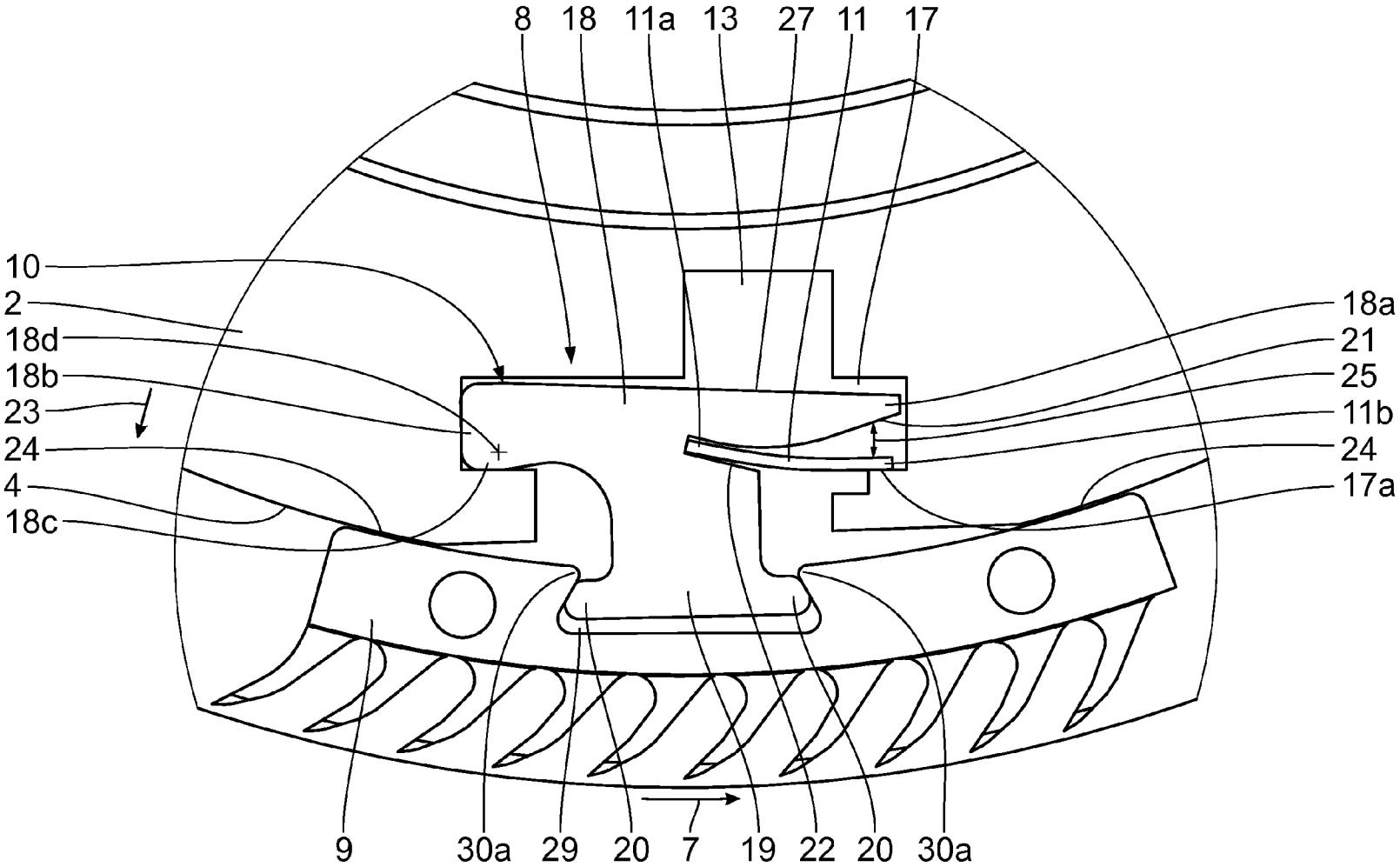
FIGS. 2 and 3 show enlarged views of a fastening device shown in FIG. 1 according to a first embodiment, comprising a profile strip in the locked and unlocked state.
Figure 3:
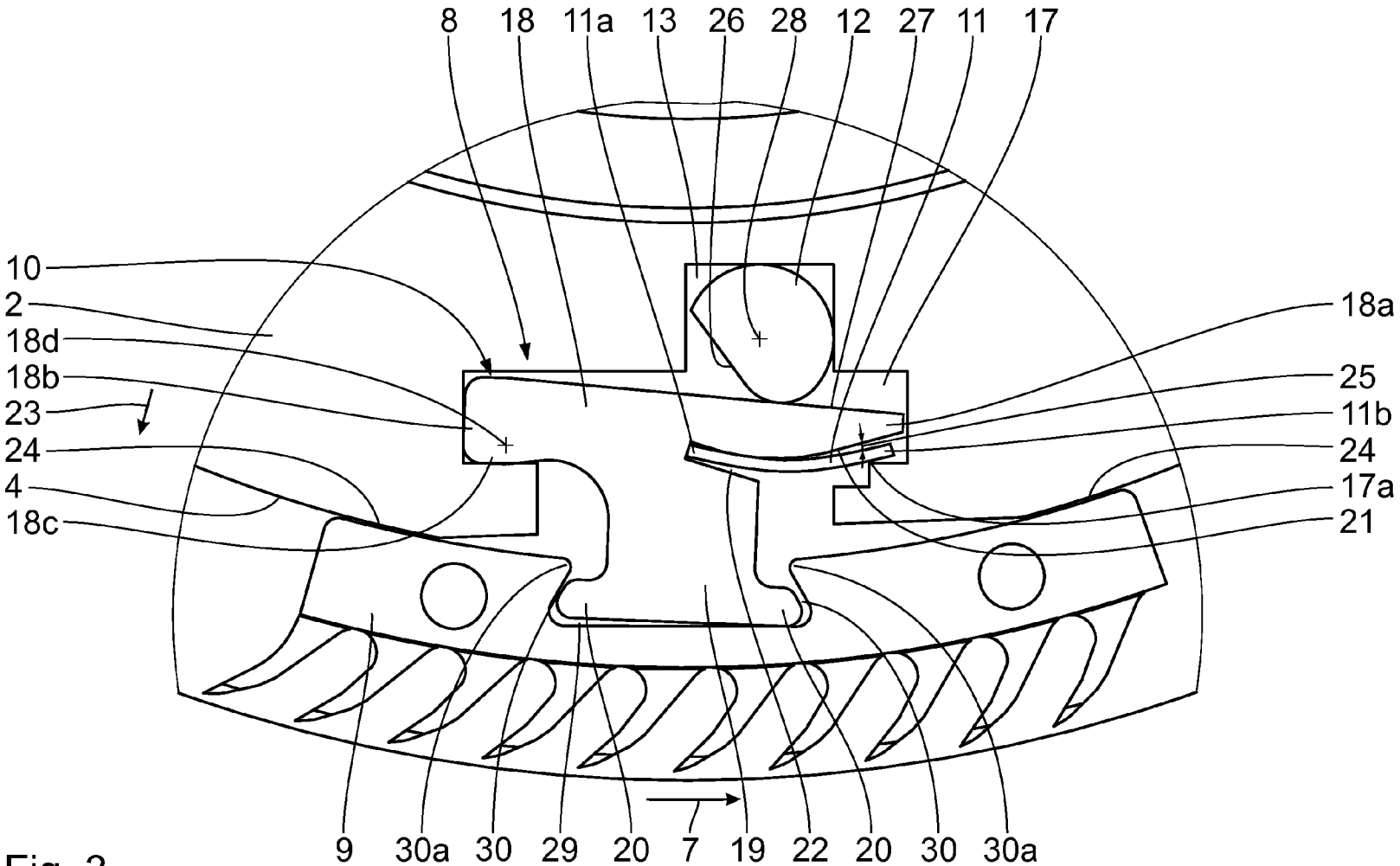

The fastening device 8 of the circular comb 1 is shown enlarged in FIGS. 2 and 3. The fastening device 8 is inserted in a fastening groove 17 of the base body 2. In this case, the profile strip 10 has a substantially double-T-shaped cross-sectional face, a T-shaped base 18 to positively receive the profile strip 10 being provided in the fastening groove 17 and a T-shaped top piece 19 with laterally projecting noses 20 being used to engage in an undercut recess 29 of the bar tack 9.

The unlocking opening 13 is arranged adjacent to the fastening groove 17 and connected thereto, so the fastening device 8 can be actuated with the inserted unlocking pin 12.

The base 18, on a first T-side projection 18*a*, has a contact face 21, adjoined by a receiving groove 22, in which the leaf spring 11 is held by a first spring part region 11*a*. The fastening device 8 is inserted into the fastening groove 17 in such a way that the leaf spring 11, which rests with a second spring part region 11*b* on a shoulder 17*a* of the fastening groove 17 formed by a first undercut, is prestressed, as the spring force of the leaf spring 11 in the radial direction 23 with respect to the centre longitudinal axis 3 is directed inwardly. The fastening device 8 is pressed inwardly in the radial direction 23 thereby, the prestressing of the leaf spring 11 resulting from an abutment of the bar tack 9 on contact regions 24 of the peripheral surface 4.

As a result of the adjacent arrangement of the contact face 21 and the leaf spring 11 held in the receiving groove 22, a radial play 25 of the fastening device 8 in the fastening groove 17 is produced. The size of the radial play 25 can be fixed by the design of the contact face 21 facing the shoulder 17*a*, the leaf spring 11 and the fastening groove 17. Since the contact face 21 has a bevel, the radial play 25 is additionally increased. When the base 18 lies with its contact surface 21 on the leaf spring 11 and therefore indirectly also on the shoulder 17*a*, the radial play 25 becomes zero, so the positive securing connection is formed. The radial play 25 is smaller than the radial spacing 15. This ensures that if the non-positive connection is released between the bar tack 9 and the base body 2, no damage to the machine wall 16 and therefore the combing machine as a whole takes place. The bar tack 9, apart from the non-positive connection, is also thereby positively connected to the base body 2. With an active non-positive connection, in other words during normal operation of the combing machine, the positive securing connection does not engage, but has the radial play 25.

The base 18 furthermore comprises a second T-side projection 18*b* with a curvature 18*c* to rest in the fastening groove 17. On actuation of the unlocking pin 12, the profile strip 10 can pivot about a pivot axis 18*d* parallel to the centre longitudinal axis 3 by a certain angular amount, which is limited by the maximum radial play 25. In this case, the profile strip 10 runs along the curvature 18*c* in a second undercut of the fastening groove 17 in an unlocking direction. A combing force occurring during combing operation acts as an additional closing force. The bar tack 9 then acts on the profile strip 10 in such a way that the latter rolls with the curvature 18*c* counter to the unlocking direction and is thus additionally held in the fastening groove 17. The combing force is produced as the resultant of the individual combing forces on the individual teeth of the bar tack 9. As a result, the non-positive connection between the bar tack 9 and the base body 2 is additionally secured and therefore increases the securing of the circular comb 1 against unintentional release of the bar tack 9 from the base body 2.

The unlocking openings 13 reach at least up to at least one of the end faces 5, so an actuation of the unlocking opening 13 with the unlocking pin 12 with a fully occupied circular comb is possible without providing accessibility of the base body 2 from its inside. As shown in FIG. 3, the unlocking pin 12 inserted in the unlocking opening 13 has a contour, the cross-sectional face of which perpendicular to the centre longitudinal axis 3 is not round and comprises a flattened side 26.

The unlocking of the bar tack 9 from the base body 2 will be described below with the aid of FIGS. 2 and 3. Proceeding from the prestressed arrangement of the fastening device 8 and the bar tack 9 in the base body 2 according to FIG. 2, the unlocking pin 12 is inserted into the unlocking opening 13 in such a way that its flattened side 26 is oriented parallel to a lower side 27 of the base 18. The unlocking pin 12 is then rotated automatically or by hand, for example by means of a special tool about the longitudinal axis 28 thereof. Because of its non-round contour, the unlocking pin 12 comes to rest in the unlocking opening 13 and simultaneously on the lower side 27, as a result of which the profile strip 10 is pressed in the radial direction 23 outwardly against the spring force of the leaf spring 11 (cf FIG. 3). In this state, the abutment of the top piece 19 with its noses 20 in contact flanks 30*a* of an undercut recess 29, which is substantially swallow tail-shaped, is dispensed with. Thus, gaps 30 are produced between the T-shaped top piece 19 of the profile strip 10 and the undercut recess 29 of the bar tack 9 in the regions of the noses 20 and the recess 29 on which there was previously contact, in the unlocked state. The gaps 30 allow a displacement of the bar tack 9 along the centre longitudinal axis 3, as the mechanical holding force of the leaf spring 11 is removed.

Figure 4:
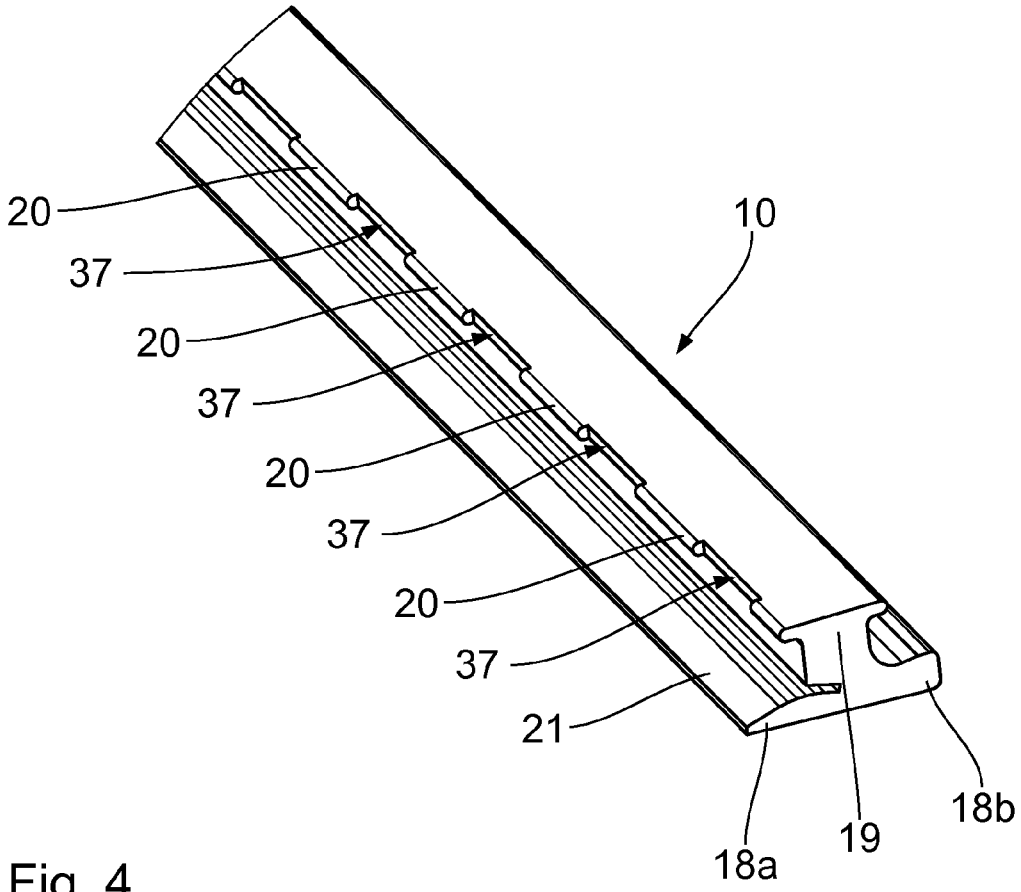
FIG. 4 shows a perspective view of a profile strip for use in a circular comb according to the first embodiment.

FIG. 4 shows the profile strip 10 in a perspective view, whereby it becomes visible that the nose 20 of the T-shaped top piece 19 arranged above the contact face 21 has interruptions 37 in the direction parallel to the centre longitudinal axis 3 of the base body 2. With recesses of the bar tack 9 corresponding to this, assembly and disassembly of the bar tack 9 on or from the base body 2 is facilitated in that the profile strip 10 in the unlocked state is displaced in the direction of the centre longitudinal axis 3 by the amount of the longitudinal extent of the interruptions 37 and can be removed in the radial direction 23 when the interruptions 37 overlap with the recesses of the bar tack 9, which have the same longitudinal extent as the interruptions 37. As a result the pushing of the bar tack 9 onto the profile strip 10 over the entire lengths thereof in the direction of the centre longitudinal axis 3 is avoided, so that, in particular, a necessary space requirement on the combing machine is reduced and the assembly and disassembly process can be accelerated.

Figure 5:
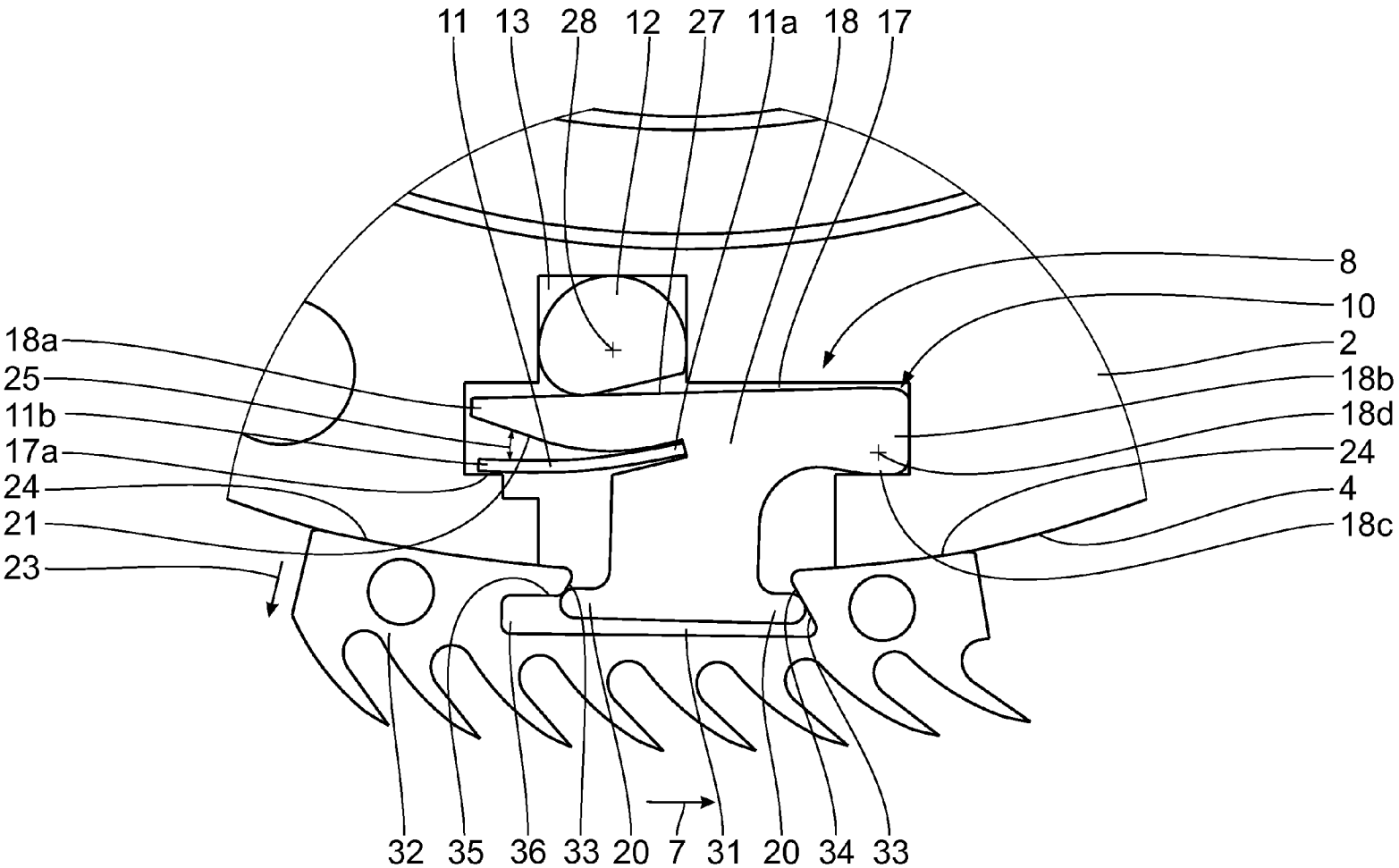
FIGS. 5 and 6 show views similar to FIGS. 2 and 3 of a fastening device according to a second embodiment of a circular comb.
Figure 6:
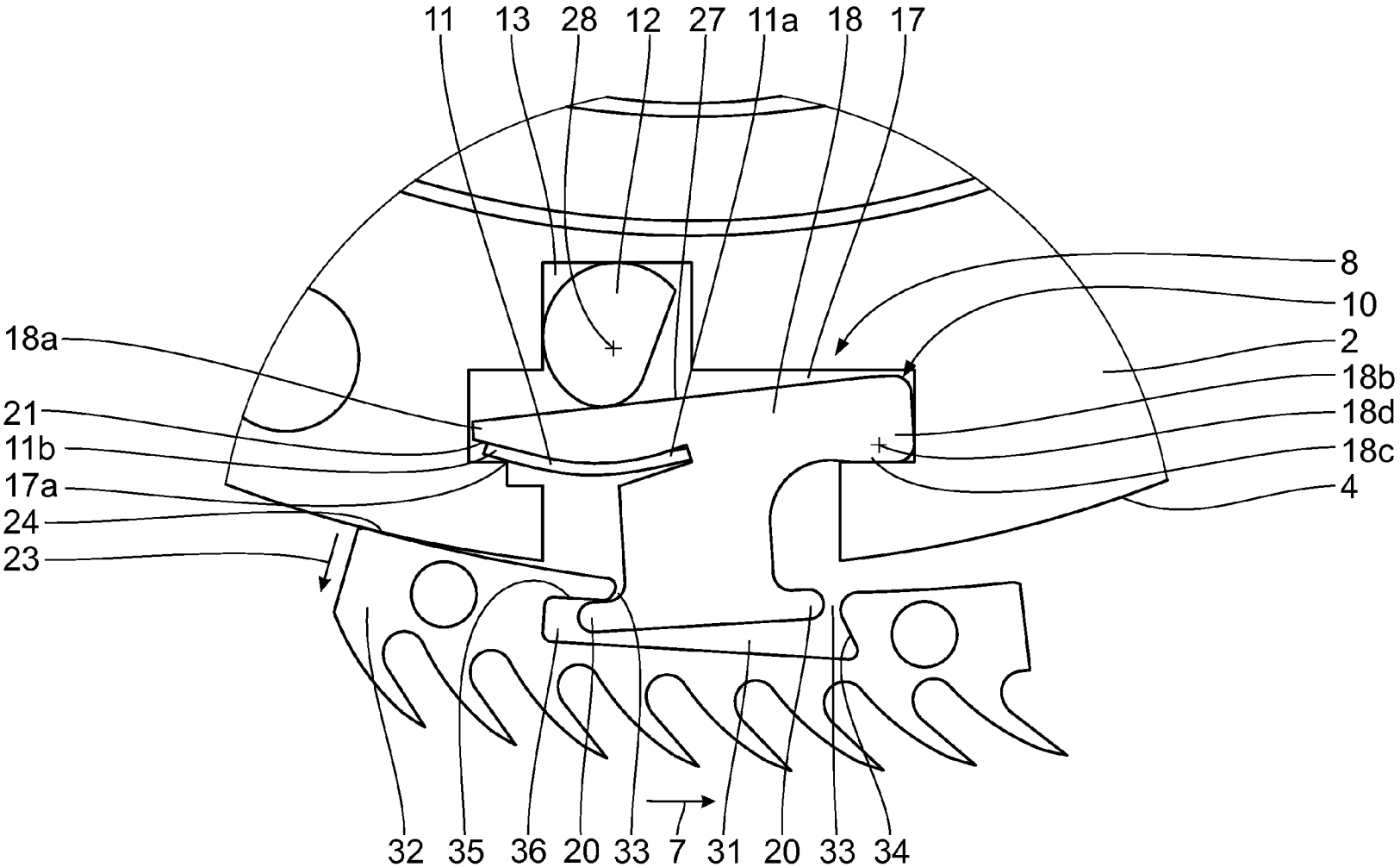

FIGS. 5 and 6 show a further embodiment of a circular comb 1. Components which correspond to those which have already been described above with reference to FIGS. 1 to 4 have the same reference numerals and will not be discussed again in detail.

An important difference of this embodiment from that described above is the design of the undercut recess 31 of the bar tack 32. The recess 31 also has oblique contact flanks 33, on which the noses 20 rest with an active non-positive connection between the bar tack 32 and the base body 2. While a first side flank 34 is designed analogously to a swallow tail-shaped recess, a second side flank 35 is distinguished by a recess 36, which extends in the bar tack 32 substantially in the peripheral direction 7.

The disassembly process of the bar tack 32 from the base body 2, which will be described below with the aid of FIG. 5, is simplified with the recess 36 in the following manner:

By actuating the unlocking pin 12 in the unlocking opening 13 by rotation about its longitudinal axis 28, the profile strip 10, as described above, is raised outwardly in the radial direction 23. This results in a tilting of the profile strip 10 in the fastening groove 17 of the base body 2. Because of the special design of the undercut recess 31, the bar tack 32 can be raised in the unlocked position of the fastening device 8 from the peripheral surface 4 of the base body 2 and disassembled in the radial direction 23 from the base body 2. For this purpose, a nose 20 is pushed into the recess 36, so the raising of the bar tack 32 and therefore the radial disassembly is firstly made possible.

Figure 7:
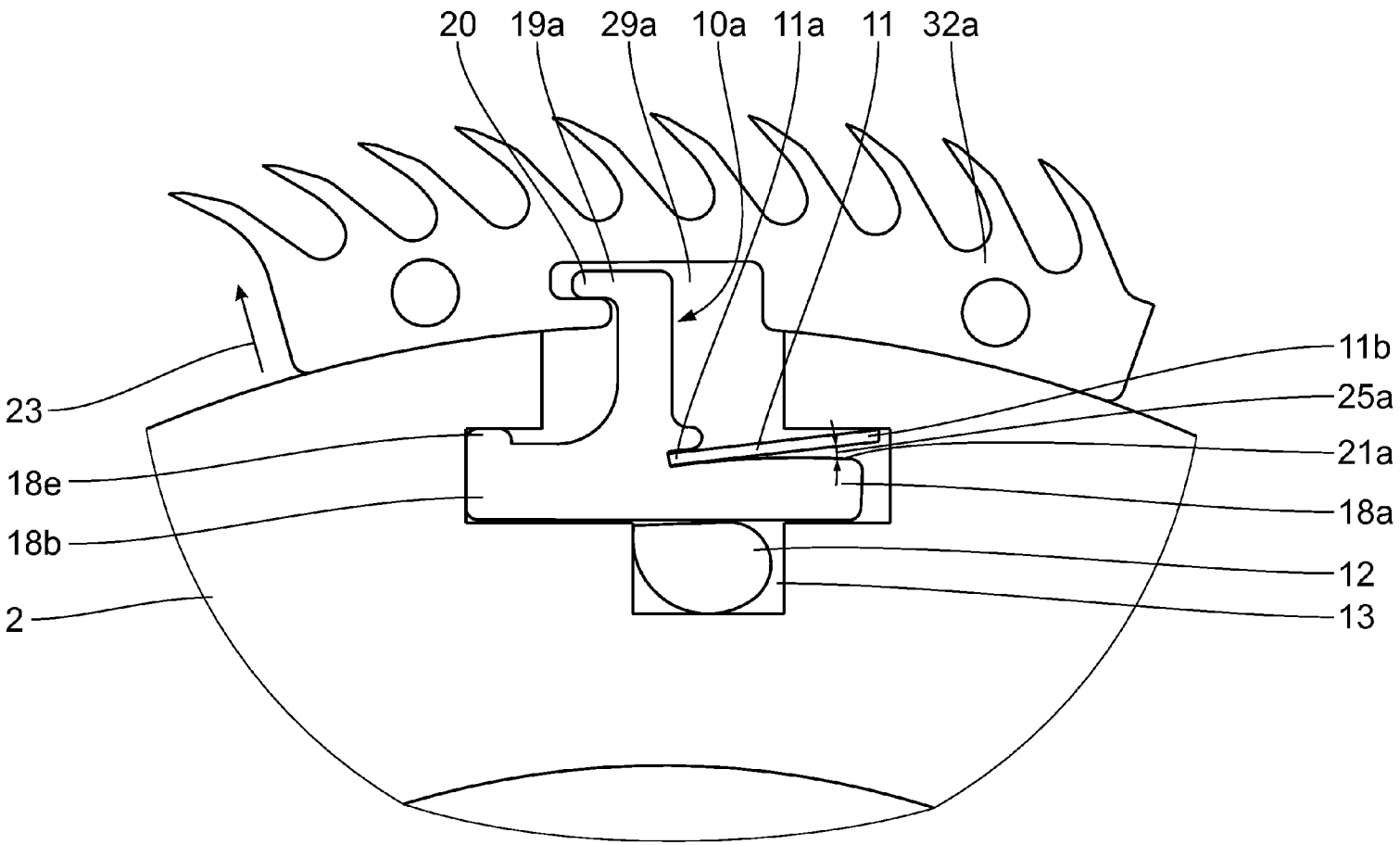
FIGS. 7 and 8 show views similar to FIGS. 2 and 3 of a fastening device according to a third embodiment of a circular comb.
Figure 8:
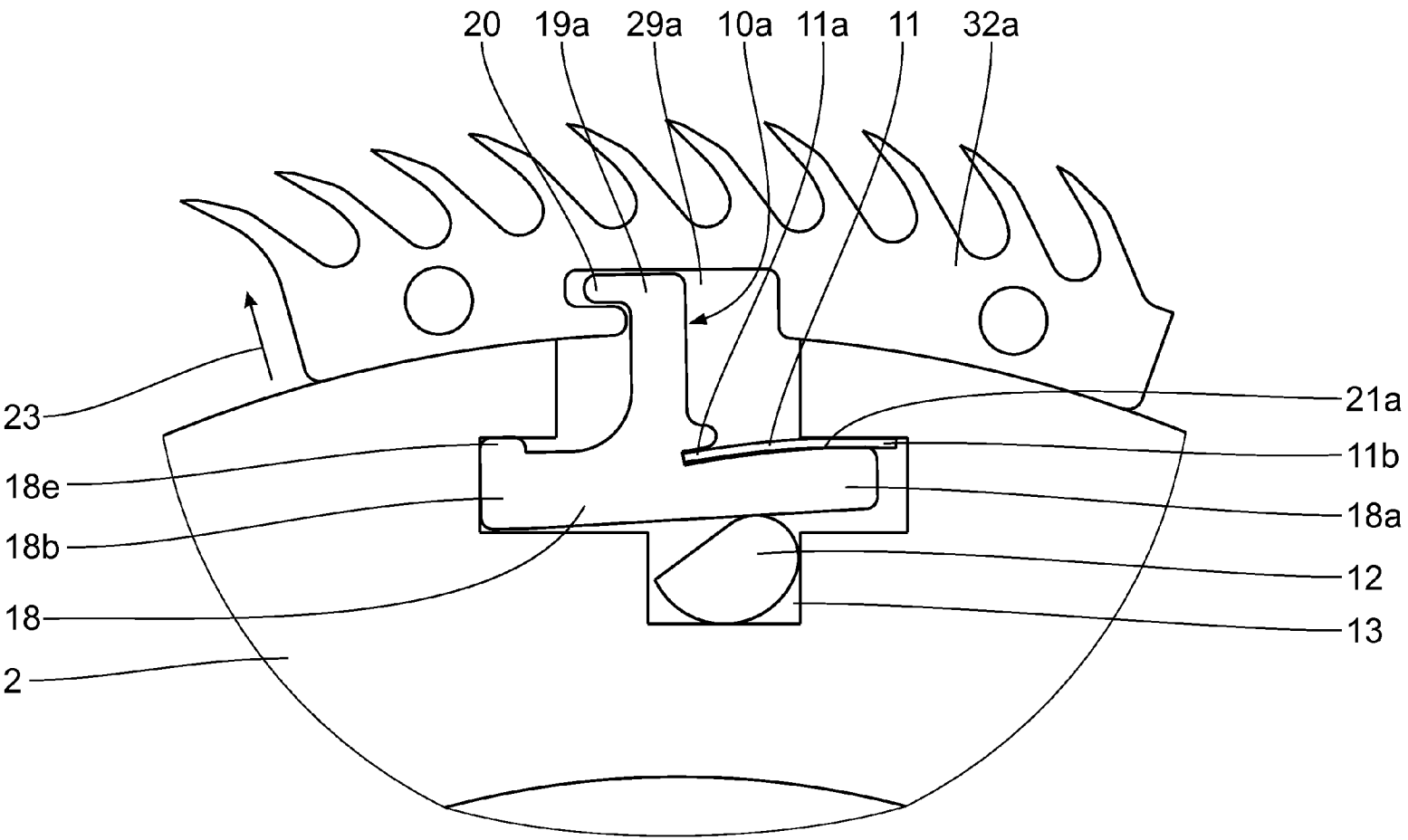

FIGS. 7 and 8 show a further embodiment of a circular comb 1. Components which correspond to those which have already been described above with reference to FIGS. 1 to 6 have the same reference numerals and will not be discussed again in detail.

An important difference of this embodiment from that described above is the design of the profile strip 10*a*, which has an L-shaped top piece 19*a* with only one projecting nose 20.

Therefore, with the unlocked non-positive connection, the bar tack 32*a*, which comprises a recess 29*a* to receive the L-shaped top piece 19*a*, can be directly withdrawn or lifted from the base body 2. Furthermore, no bevel is provided on a contact face 21*a* of the first T-side projection 18*a*, as, because of the design of the top piece 19*a*, a comparatively small radial play 25*a* is sufficient to allow the unlocking process. The curvature on the second T-side projection 18*b* is configured as a plateau 18*e*. The nose 20 of the top piece 19*a* is arranged on the same side of the profile strip 10*a* as the plateau 18*e* on the second T-side projection 18*b* and therefore opposing the leaf spring 11 and the contact face 21*a* adjacent thereto.

Figure 9:
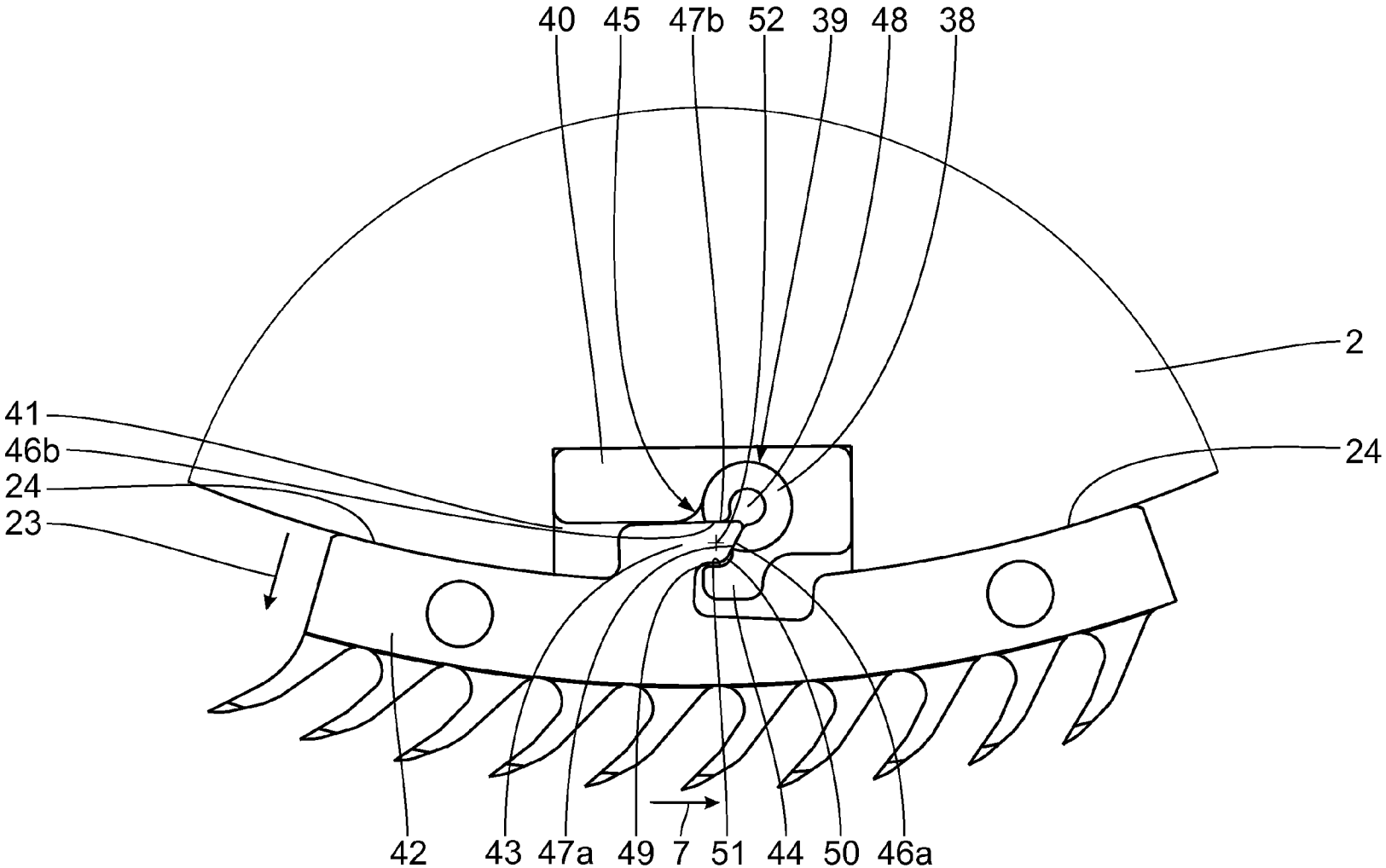
FIG. 9 shows a view similar to FIGS. 2, 5 and 7 of a fourth embodiment of a circular comb with a rod-shaped magnet as the fastening device.

FIG. 9 shows a further configuration of a circular comb 1. Components which correspond to those which have already been described above with reference to FIGS. 1 to 8 have the same reference numerals and will not be discussed again in detail.

The important difference from the above-described embodiments of a circular comb 1 is the configuration of the fastening device which is configured as a rod-shaped magnet 38. The magnet 38 is arranged in a fastening groove 39 of a holding body 40, the holding body 40 being fastened in a holding groove 41 of the base body 2. The fastening can, for example, take place by means of screwing or gluing. It is also possible for no separate holding body to be provided and for the fastening groove 39 to be directly incorporated in the base body 2.

The holding force of the non-positive connection between the bar tack 42, which is produced from ferromagnetic material, and the base body 2 is produced by the magnetic force of the magnet 38, which can be configured as a permanent magnet or as an electromagnet, so the magnetic effect thereof can be activated and deactivated by means of a switch.

The bar tack 42 has a hook-like step 43, which engages in a receiving opening 45 of the fastening groove 39 delimited by a projection 44. The step 43 cooperates here with the magnet 38, which has a T-shaped cross-section perpendicular to the centre longitudinal axis 3, in such a way that side faces 46*a* and 46*b* of the step 43 are in contact with end faces 47*a* and 47*b* of the magnet 38. As a result, the unlocking opening 48 is formed. With an active non-positive connection between the magnet 38 and the bar tack 42, a radial play 49 is present between the step 43 of the bar tack 42 and the projection 44 of the fastening groove 39. When the magnetic holding force of the bar tack 42 is released, the latter is moved outwardly in the radial direction 23, the step 43 coming to rest with its outside 50 on an inner face 51 of the projection 44. By a corresponding design of the fastening groove 39, in particular the projection 44 and the step 43, the desired size of the radial play 49 can be fixed.

The magnet 38 is configured as a rod with a C-shaped cross-section perpendicular to the centre longitudinal axis 3, one C-end face being inclined inwardly and forming one end face 47*a* of the magnet 38. Accordingly, the corresponding side face 46*a* of the step 43 is also configured in an inclined manner, so the resulting combing force occurring during the combing process acts as an additional closing force on the non-positive connection between the bar tack 42 and the base body 2. The incline of the end face 47*a* and the side face 46*a* form an inwardly directed guide, which pulls the bar tack 42 inwardly under the influence of the combing force and therefore presses it on the base body 2.

An unlocking pin, not shown, which is conical at least in portions and can be inserted into the unlocking opening 48 parallel to the centre longitudinal axis 3 or moved back and forth, is used to unlock the bar tack 42 from the fastening groove 39. As soon as the magnetic holding force of the magnet 38 on the step 43 has been overcome by a corresponding positioning of the unlocking pin, the bar tack 42 can be displaced because of the existing radial play 49 in the fastening groove 39. As a result, a release of the abutment of the bar tack 42 in the contact regions 24 takes place and thus the possibility of tilting about a pivot axis 52 parallel to the centre longitudinal axis 3.

In this unlocked state, the bar tack 42 can be disassembled substantially radially outwardly from the fastening groove 39. A displacement in the direction of the centre longitudinal axis 3 is unnecessary for the assembly and disassembly of the bar tack 42 on or from the base body 2. Assembly of the bar tack 42 on the base body 2 takes place analogously to disassembly by pivoting the bar tack 42 with its step 43 into the receiving opening 45 of the fastening groove 39 and subsequent application of the magnetic holding force by bringing the step 43 of the bar tack 42 and the magnet 38 into contact.

Apart from the fastening devices mentioned, further configurations are possible to apply the holding force to a bar tack:

When using a tension band made of elastomer as the unlocking means, which is inserted into the unlocking opening and exerts a clamping force on the bar tack, it could be stretched by tensile loading and therefore its cross-section reduced in the direction of the centre longitudinal axis, so a release of the non-positive connection could take place.

Moreover, the holding force on a bar tack could also be produced in that a negative pressure is produced in the unlocking opening and is eliminated to release the connection by means of a venting and aeration line provided for this.

Alternatively, unlocking means would also be possible, which are produced from a shape memory alloy, so a shape of the unlocking means can be adjusted as a function of a required clamping or non-clamping effect. This could take place, for example, by varying the cross-section perpendicular to the centre longitudinal axis.

The invention claimed is:

1. A circular comb for a combing machine for combing textile fibres, comprising:

a base body with a centre longitudinal axis, a peripheral surface and two end faces, a plurality of bar tacks, which are arranged on the peripheral surface of the base body and define a combing region of the circular comb, a plurality of fastening devices attached to the base body for the non-positive connection of one of the bar tacks in each case to the base body and unlocking units to release the non-positive connections, each unlocking unit having an unlocking device and an unlocking means to actuate the unlocking device, wherein the unlocking units are accessible from outside the combing region, and an additional positive securing connection to secure the bar tacks is provided on the base body.

2. A circular comb for a combing machine for combing textile fibres according to claim 1, wherein the unlocking units are accessible from at least one of the end faces, and an additional positive securing connection to secure the bar tacks is provided on the base body.

3. A circular comb according to claim 1, wherein the positive securing connection between one of the bar tacks and the base body in each case has a radial play.

4. A circular comb according to claim 3, wherein the play is smaller than a radial spacing of the bar tack non-positively connected to the base body from a machine wall of the combing machine.

5. A circular comb according to claim 1, further comprising a design of the bar tack the fastening device in such a way that assembly and disassembly of the bar tack one of on and from the base body substantially take place in the radial direction.

6. A circular comb according to claim 1, further comprising an unlocking opening in the base body, which extends parallel to the centre longitudinal axis, as an unlocking device, and an unlocking pin, which can be moved to release the non-positive connection in the unlocking opening, as an unlocking means.

7. A circular comb according to claim 1, further comprising a design of the bar tack the fastening device such that a combing force acts as a closing force in a securing manner on the bar tack.

8. A circular comb according to claim 1, wherein the fastening device comprises a profile strip and a leaf spring.

9. A circular comb according to claim 8, wherein each profile strip has a top piece with at least one laterally projecting nose to engage in undercut recesses of the bar tack.

10. A circular comb according to claim 9, further comprising a T-shaped top piece with two laterally projecting noses, at least one nose, in the direction parallel to the centre longitudinal axis, having interruptions, which correspond with corresponding recesses of the bar tack for the assembly and disassembly thereof.

11. A circular comb according to claim 9, further comprising an L-shaped top piece with a laterally projecting nose.

12. A circular comb according to claim 8, wherein the leaf spring, to non-positively connect the bar tacks and base body, is held with a first spring part region in a receiving groove of the profile strip and rests with a second spring part region (11*b*) on a shoulder of a fastening groove of the base body.

13. A circular comb according to claim 12, wherein the positive securing connection between one of the bar tacks and the base body in each case has a radial play and each profile strip has an T-shaped base with a contact face provided on a T-shaped side projection, wherein the contact face, to form the positive securing connection, can rest on the leaf spring and therefore indirectly also on the shoulder of the fastening groove and wherein the radial play is determined by the design of the contact face, the leaf spring and the fastening groove.

14. A circular comb according to claim 6, wherein the unlocking pin is rotatably arranged in the unlocking opening and the contour of the cross-sectional face of the unlocking pin running perpendicular to the centre longitudinal axis is not round.

15. A circular comb according to claim 1, wherein the fastening device is a rod-shaped magnet, the non-positive connection between the bar tack and the base body being provided by the magnetic force of the magnet.

16. A circular comb according to claim 15, wherein the magnet is a permanent magnet.

17. A circular comb according to claim 15, wherein the magnet is an electromagnet, the magnetic effect of which can be activated and deactivated by means of a switch.

18. A circular comb according to claim 15, wherein the magnet is rigidly arranged in a fastening groove of the base body.

19. A circular comb according to claim 3, wherein the positive securing connection between one of the bar tacks and the base body in each case has a radial play and each bar tack has a hook-like step, which, to form the positive securing connection, engages in a receiving opening of the fastening groove limited by a projection, the radial play being determined by a radial spacing provided in a non-positive connection between the projection and the hook-like step engaging below the projection.

20. A circular comb according to claim 15, wherein the magnet has a C-shaped cross-section perpendicular to the centre longitudinal axis, the unlocking opening being formed by the magnet and the bar tack connected thereto.

21. A circular comb according to 12, further comprising an unlocking pin which is conical at least in portions.

22. A circular comb according to claim 1, wherein the fastening devices and the unlocking units are attached to the base body in such a way that they are connected, both during combing operation and also during assembly and disassembly of the bar tack one of on and from the base body, to said base body and can be brought, at least partially, into one of the group of a loosened, but not completely separated assembly and disassembly state.

23. A circular comb for a combing machine for combing textile fibres, comprising:

a base body with a centre longitudinal axis, a peripheral surface and two end faces, a plurality of bar tacks, which are arranged on the peripheral surface of the base body and define a combing region of the circular comb, a plurality of fastening devices attached to the base body for the non-positive connection of one of the bar tacks in each case to the base body and unlocking units to release the non-positive connections, each unlocking unit having an unlocking device and an unlocking means to actuate the unlocking device, wherein the unlocking units are accessible from outside the combing region, and the fastening devices and the unlocking units are attached to the base body in such a way that both during combing operation and also during assembly and disassembly of the bar tack one of on and from the base body, they are connected to the latter and can, at least partially, be brought into one of the group of a loosened, but not completely separated assembly and disassembly state.

24. A circular comb for a combing machine for combing textile fibres, according to claim 23, wherein the unlocking units are accessible from at least one of the end faces, and the fastening devices and the unlocking units are attached to the base body in such a way that both during combing operation and also during assembly and disassembly of the bar tack one of on and from the base body, they are connected to the latter and can, at least partially, be brought into one of the group of a loosened, but not completely separated assembly and disassembly state.

25. A circular comb according to claim 24, wherein an additional positive securing connection is provided to secure the bar tacks on the base body.

* * * * *